US010428840B2

(12) United States Patent
Ohta et al.

(10) Patent No.: US 10,428,840 B2
(45) Date of Patent: Oct. 1, 2019

(54) BLOWER PROVIDED WITH STRUCTURE SUPPRESSING DAMAGE TO SHAFT SEAL

(71) Applicant: FANUC CORPORATION, Minamitsuru-gun, Yamanashi (JP)

(72) Inventors: Kazuya Ohta, Yamanashi (JP); Satoru Kawai, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 147 days.

(21) Appl. No.: 15/079,230

(22) Filed: Mar. 24, 2016

(65) Prior Publication Data

US 2016/0281744 A1 Sep. 29, 2016

(30) Foreign Application Priority Data

Mar. 25, 2015 (JP) ..... 2015-063413

(51) Int. Cl.
*F04D 17/16* (2006.01)
*F04D 29/10* (2006.01)
*F04D 29/70* (2006.01)

(52) U.S. Cl.
CPC ..... *F04D 29/701* (2013.01); *F04D 17/16* (2013.01); *F04D 29/102* (2013.01)

(58) Field of Classification Search
CPC ..... F04D 29/70; F04D 29/701; F04D 29/703; F04D 29/708; F04D 29/041; F04D 29/051; F04D 29/162; F04D 29/167; F04D 29/2266
See application file for complete search history.

(56) References Cited

U.S. PATENT DOCUMENTS 4,385,768 A * 5/1983 Swearingen ..... F16C 17/26 277/321
4,997,340 A * 3/1991 Zinsmeyer ..... F04D 29/102 415/105
5,124,997 A 6/1992 Funakubo et al.
5,461,636 A * 10/1995 Karube ..... F04D 29/063 372/58
5,856,992 A * 1/1999 Karube ..... F04D 29/102 372/58
2005/0083985 A1 4/2005 Egawa et al.
(Continued)

FOREIGN PATENT DOCUMENTS

CN 201363312 Y 12/2009
JP 6049291 U 4/1985
(Continued)

*Primary Examiner* — Woody A Lee, Jr.
*Assistant Examiner* — Christopher R Legendre
(74) *Attorney, Agent, or Firm* — RatnerPrestia

(57) ABSTRACT

The blower of the present invention comprises a gas blowing part which holds an impeller which blows gas, a motor part which holds a rotor which makes the impeller rotate, and a partition wall part which partitions the gas blowing part from the motor part. The top end part of the rotor in the axial direction passes through the partition wall part and supports the center of rotation part of the impeller present inside the gas blowing part. At the through hole of the partition wall part through which the top end part of the rotor in the axial direction passes, a noncontact type shaft seal is arranged. Further, the surface of the partition wall part facing the impeller is formed with a groove for trapping foreign matter.

8 Claims, 12 Drawing Sheets

(56) References Cited

U.S. PATENT DOCUMENTS

| | | | | |
|---|---|---|---|---|
| 2016/0153471 | A1* | 6/2016 | Oda | F04D 17/12<br>415/121.2 |
| 2016/0281744 | A1* | 9/2016 | Ohta | F04D 29/701 |

FOREIGN PATENT DOCUMENTS

| | | | | |
|---|---|---|---|---|
| JP | H05240353 | A | | 9/1993 |
| JP | H07211965 | A | | 8/1995 |
| JP | H08205467 | A | | 8/1996 |
| JP | 8335731 | A | | 12/1996 |
| JP | H08326685 | A | | 12/1996 |
| JP | H08335731 | A | | 12/1996 |
| JP | 09004585 | A | * | 1/1997 |
| JP | H09196186 | A | | 7/1997 |
| JP | 10026005 | A | | 1/1998 |
| JP | 2002242699 | A | | 8/2002 |
| JP | 2012144995 | A | | 8/2012 |
| JP | 201517535 | A | | 1/2015 |

* cited by examiner

PRIOR ART

PRIOR ART

BLOWER PROVIDED WITH STRUCTURE SUPPRESSING DAMAGE TO SHAFT SEAL

BACKGROUND OF THE INVENTION

1. Field of the Invention

The present invention relates to a blower which sucks in a gas, makes the sucked in gas rise in temperature, and discharges it from a discharge port, more particularly relates to a blower for gas laser oscillator use for making a laser gas circulate inside the gas laser oscillator.

2. Description of the Related Art

A blower which sucks in a gas, makes the sucked in gas rise in temperature, and discharges it from a discharge port has been known since the past. Such a blower, as shown in Japanese Patent Publication No. 8-335731A, is used for making a laser gas circulate inside a gas laser oscillator.

FIG. 14 is a cross-sectional view showing the configuration of a conventional blower. Here, an example of an oil lubrication type of blower for gas laser oscillator use will be shown.

A blower 100 shown in FIG. 14 is provided with a gas blowing part 2 which blows gas by rotation of an impeller 1 and a motor part 3 for making the impeller 1 rotate.

A casing 4 of the gas blowing part 2 surrounds the impeller 1 and is formed integrally with a casing 5 of the motor part 3. Furthermore, the casing 4 of the gas blowing part 2 is formed with a single suction port 4*a* for sucking in a gas and discharge ports 4*b*, 4*c* for discharging the gas. By the impeller 1 rotating about a center axis X, the gas is sucked in from the suction port 4*a* as shown by the arrow 6 in the figure and is discharged from the discharge ports 4*b*, 4*c* as shown by the arrows 7, 8.

The casing 5 of the motor part 3 holds a rotor 9 for making the impeller 1 rotate. Further, the casing 5 of the motor part 3 is provided with a partition wall part 5*a* which partitions the space inside the casing 4 of the gas blowing part 2 from the space inside the casing 5 of the motor part 3. The center of rotation of the impeller 1 and the center of rotation of the rotor 9 are on the same center axis X. Further, at the inner circumferential surface of the casing 5 of the motor part 3, a stator 10 is set so as to surround the rotor 9. The rotor 9 can rotate by receiving electromagnetic force from the stator 10.

In an oil lubrication type of blower 100, the rotor 9 is arranged in the vertical direction. Further, at the inside bottom part of the casing 5 of the motor part 3, an oil reservoir 14 which stores the lubricating oil is formed.

Inside the oil reservoir 14, a bearing part 11 is arranged for supporting a bottom end part 9*a* of the rotor 9 in the axial direction to be able to rotate and so that it is immersed in the oil. On the other hand, a top end part 9*b* of the rotor 9 in the axial direction passes through the partition wall part 5*a* and sticks out inside the gas blowing part 2. Further, the top end part 9*b* of the rotor 9 in the axial direction is coupled with a center of rotation part of the impeller 1.

The partition wall part 5*a* is formed with a through hole through which the top end part 9*b* of the rotor 9 in the axial direction passes. A bearing part 12 is arranged in the through hole. The top end part 9*b* of the rotor 9 in the axial direction is supported at the bearing part 12 to be able to rotate.

Further, the rotor 9 is designed to utilize a centrifugal force accompanying the high speed rotation of the rotor 9 to be able to supply part of the oil of the oil reservoir 14 to the bearing part 12. The supplied oil is used for lubricating the bearing part 12 and then is returned to the oil reservoir 14.

Further, at the through hole of the partition wall part 5*a* through which the top end part 9*b* of the rotor 9 in the axial direction passes, a shaft seal 13 is arranged to adjoin the bearing part 12. Due to this, it becomes difficult for the oil which is supplied to the bearing part 12 to enter the casing 4 of the gas blowing part 2.

However, the top end part 9*b* of the rotor 9 in the axial direction is the high speed rotating shaft part, so as the shaft seal 13, to not interfere with high speed rotation of the shaft part, a noncontact type shaft seal, for example, a labyrinth seal, is employed.

Furthermore, to prevent the oil from entering the inside of the gas blowing part 2 from the motor part 3, the casing 5 of the motor part 3 is formed with an exhaust port 5*b*. By constantly evacuating the inside space of the casing 5 of the motor part 3 from the exhaust port 5*b*, the pressure inside of the motor part 3 is made lower than the pressure inside the gas blowing part 2. Due to this, the oil inside the motor part 3 is kept from entering the inside of the gas blowing part 2 and being dispersed by the impeller 1 inside the gas laser oscillator.

As explained above, in the conventional blower 100, a noncontact type shaft seal 13 is arranged in the clearance between the outer circumferential surface of the top end part 9*b* of the rotor 9 in the axial direction and the inner circumferential surface of the through hole through which this top end part 9*b* passes. Furthermore, the inside space of the casing 5 of the motor part 3 is evacuated. For this reason, part of the gas inside the gas blowing part 2 is sucked into the casing 5 of the motor part 3; therefore, a flow of gas is created from the gas blowing part 2 to the inside of the motor part 3. If a flow of gas 15 to the inside of the motor part 3 is created, this flow of gas 15 is liable to cause the particle-like foreign matter 16 to reach the shaft seal 13.

FIG. 15 is a cross-sectional view of the surroundings of the shaft seal 13 in the conventional blower 100 and schematically shows the state where the foreign matter 16 reaches the shaft seal 13.

As shown in FIG. 15, the noncontact type shaft seal 13 has a rotating part 13*a* which rotates along with the rotation of the rotor 9 and a fixed part 13*b* which does not rotate. There is a clearance between the rotating part 13*a* and the fixed part 13*b*. However, that clearance is made as small as possible so as to secure an oil sealing ability. For this reason, the foreign matter 16 is liable to reach the shaft seal 13, the foreign matter 16 is liable to end up being caught in the clearance present at the shaft seal 13, and the shaft seal 13 is liable to seize and be damaged.

SUMMARY OF INVENTION

The present invention provides a blower which can reduce damage to a noncontact type shaft seal part.

A first aspect of the present invention provides a blower comprising a gas blowing part which is configured to hold an impeller blowing a gas, a motor part which is configured to hold a rotor which makes the impeller rotate, and a partition wall part which partitions the gas blowing part from the motor part, wherein one end part of the rotor passes through the partition wall part to support the center of rotation part of the impeller present inside the gas blowing part, a noncontact type shaft seal is arranged at a through hole of the partition wall part through which the one end part passes, and the surface of the partition wall part facing the impeller is formed with at least one of a plurality of grooves for trapping foreign matter.

According to a second aspect of the present invention, there is provided the blower of the first aspect wherein at least one of the plurality of grooves is a ring-shaped groove which surrounds the shaft seal.

According to a third aspect of the present invention, there is provided the blower of the second aspect wherein when a distance between an axis of rotation of the impeller and a side surface of the ring-shaped groove at the outer circumference side is "r1", a distance between an axis of rotation of the impeller and a side surface of the ring-shaped groove at the inner circumference side is "r2", a distance between the impeller and the partition wall part is "h1", and a distance between the surface of the impeller facing the partition wall part and a bottom surface of the ring-shaped groove is "h2", the ring-shaped groove is formed so as to satisfy the relationships of $r2<r1$, $h1<h2$, and $r1 \cdot h1<r2 \cdot h2$.

According to a fourth aspect of the present invention, there is provided the blower of the first aspect or second aspect wherein the surface of the partition wall part is formed with the plurality of grooves.

According to a fifth aspect of the present invention, there is provided the blower of any of the first aspect to fourth aspect wherein an adhesive is arranged inside the groove.

According to a sixth aspect of the present invention, there is provided the blower of any of the first aspect to fifth aspect further comprising a detection device which detects a predetermined amount of foreign matter being built up in the groove.

According to a seventh aspect of the present invention, there is provided the blower of any of the first aspect to sixth aspect wherein the partition wall part is formed with a discharge path which discharges foreign matter which has built up in the groove.

According to an eighth aspect of the present invention, there is provided the blower of any of the first aspect to seventh aspect wherein the surface of the partition wall part in which the groove is formed is perpendicular to the vertical direction.

According to a ninth aspect of the present invention, there is provided a blower according to any of the first aspect to the eighth aspect wherein the motor part is formed with an exhaust port which evacuates the inside space of the motor part.

These objects, features, and advantages of the present invention and other objects features and advantages will become further clearer from the detailed description of representative embodiments of the present invention shown in the attached drawings.

DESCRIPTION OF THE PREFERRED EMBODIMENTS

Figure 14:
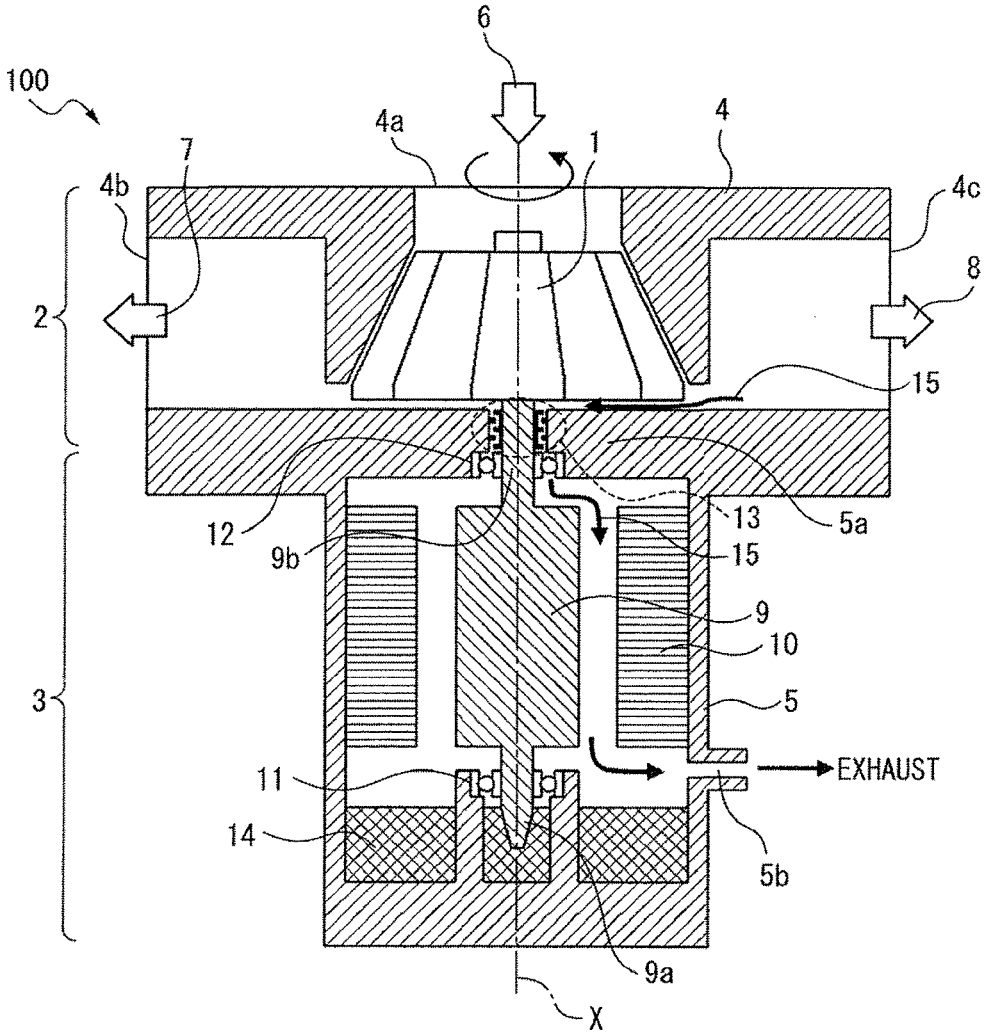
FIG. 14 is a cross-sectional view showing the configuration of a conventional blower.

Next, embodiments of the present invention will be explained with reference to the drawings. In the following drawings, similar members are assigned similar reference notations. To facilitate understanding, these drawings are suitably changed in scale. Further, in the following embodiments, the same as component parts of the conventional blower shown in FIG. 14 are assigned the same notations and overlapping explanations are omitted.

First Embodiment

Figure 1:
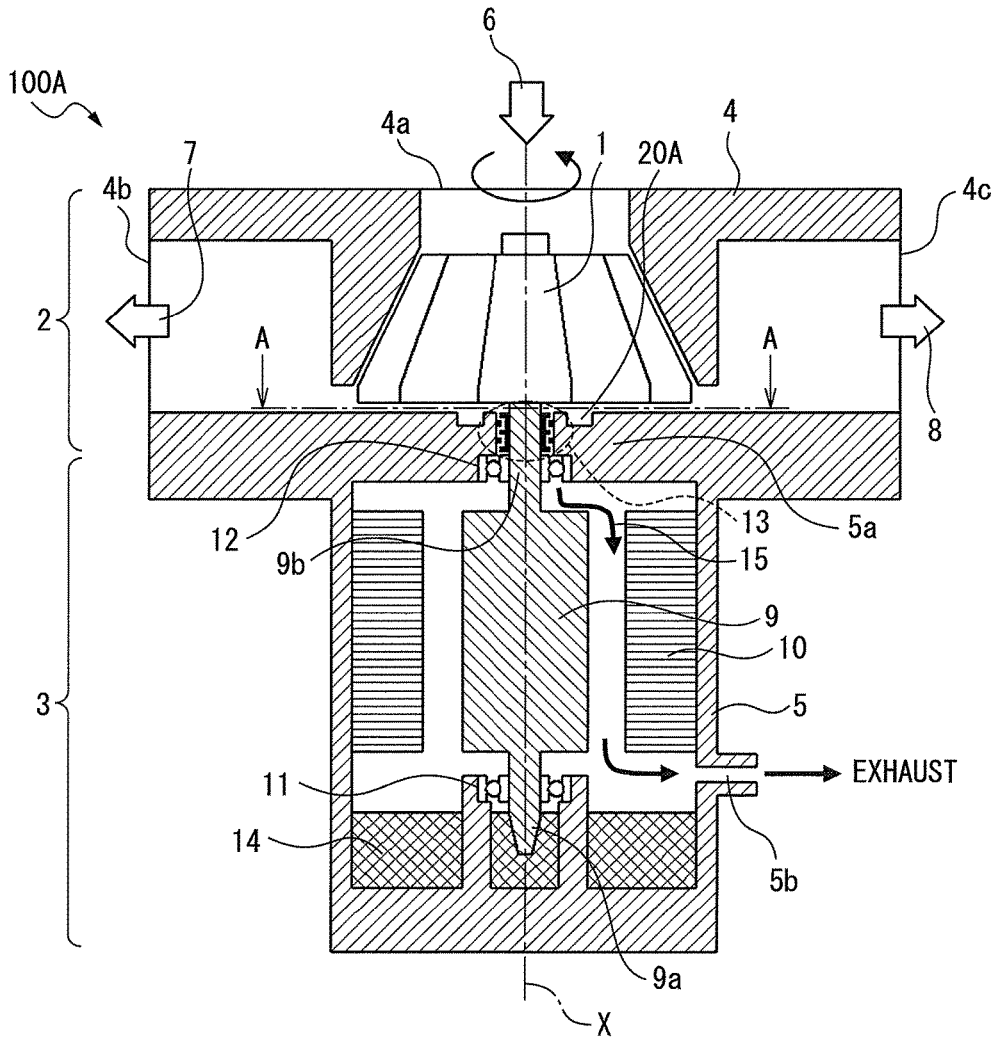
FIG. 1 is a cross-sectional view showing a blower of a first embodiment.
Figure 2:
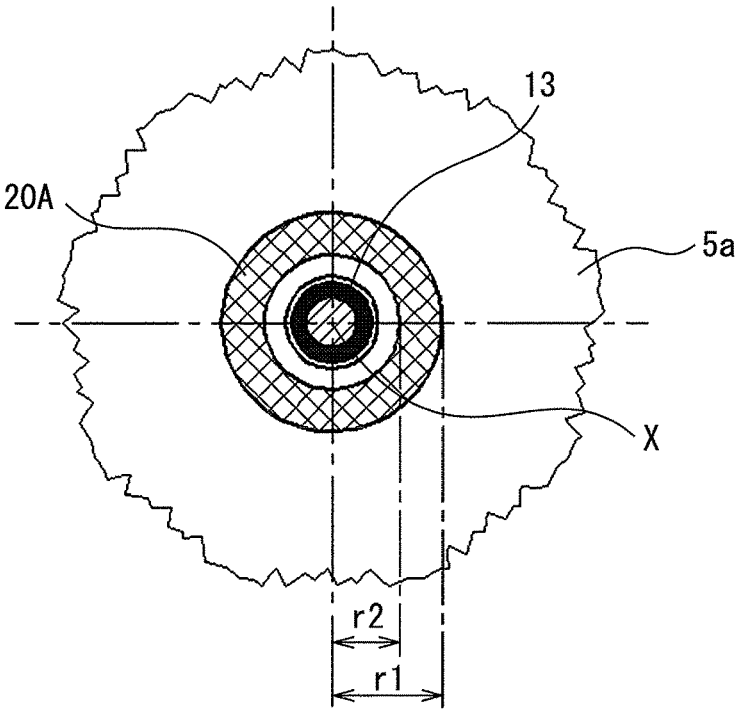
FIG. 2 is a cross-sectional view seen along the line A-A in FIG. 1.

FIG. 1 is a cross-sectional view of a blower 100A of the first embodiment. FIG. 2 is a cross-sectional view as seen along the line A-A in FIG. 1.

The blower 100A of the first embodiment is provided with a gas blowing part 2 which blows gas by rotation of an impeller 1 and a motor part 3 which makes the impeller 1 rotate.

A casing 4 of the gas blowing part 2 surrounds the impeller 1. The casing is formed with a single suction port 4*a* for sucking in gas as shown by the arrow mark 6 and discharge ports 4*b*, 4*c* for discharging gas such as shown by the arrow marks 7, 8.

The casing 5 of the motor part 3 holds a rotor 9. Furthermore, a casing 5 of the motor part 3 is provided with a partition wall part 5*a* which partitions the space inside the casing 4 of the gas blowing part 2 from the space inside the casing 5 of the motor part 3. Further, at the inner circumferential surface of the casing 5 of the motor part 3, a stator 10 is set. The rotor 9 can rotate by receiving electromagnetic force from the stator 10.

The blower 100A of the first embodiment is an oil lubrication type of blower. The rotor 9 is arranged in the vertical direction.

The bottom end part 9*a* of the rotor 9 in the axial direction is supported to be able to rotate at the bearing part 11 which is set at the inside bottom part of the casing 5 of the motor part 3. Furthermore, the bottom end part 9*a* of the rotor 9 in the axial direction is immersed in an oil reservoir 14 which is provided at the inside bottom part of the casing 5 of the motor part 3.

On the other hand, the top end part 9*b* of the rotor 9 in the axial direction passes through the partition wall part 5*a* and sticks out inside of the casing 4 of the gas blowing part 2. Further, the top end part 9*b* of the rotor 9 in the axial direction is coupled with a center of rotation part of the impeller 1. Furthermore, a bearing part 12 is arranged at the through hole of the partition wall part 5*a* through which top end part 9*b* of the rotor 9 in the axial direction passes. The top end part 9*b* of the rotor 9 in the axial direction is supported at the bearing part 12 to be able to rotate.

Further, inside of the rotor 9, an oil passage (not shown) is formed along the axial direction of the rotor 9. The bottom end part 9*a* of the rotor 9 in the axial direction is formed with an inlet (not shown) of the oil passage. An outlet (not shown) of the oil passage is formed near the vicinity of the bearing part 12 in the top end part 9*b* of the rotor 9 in the axial direction.

In such a configuration, the oil which has entered the oil passage inside the rotor 9 is pushed against the inside wall surface of the oil passage by the centrifugal force accompanying high speed rotation of the rotor 9. At this time, the oil is acted on by a force component in a direction trying to push up the oil along the inside wall surface of the oil passage. As a result, the oil is sucked up from the inlet of the oil passage at the bottom end part 9*a* of the rotor 9 in the axial direction. Furthermore, the sucked up oil passes through the oil passage inside the rotor 9 and is discharged from the outlet of the oil passage at the top end part 9*b* of the rotor 9 in the axial direction. Due to this, part of the discharged oil is supplied to the bearing part 12 and used for lubricating the bearing part 12, then is returned to the oil reservoir 14.

Furthermore, at the through hole of the partition wall part 5*a* through which the top end part 9*b* of the rotor 9 in the axial direction passes, a shaft seal 13 is arranged to adjoin the bearing part 12. Due to this, the oil which is supplied to the bearing part 12 makes it difficult to enter the casing 4 of the gas blowing part 2. As the shaft seal 13, a noncontact type shaft seal, for example, a labyrinth seal, is used so as not to interfere with high speed rotation of the rotor 9.

The noncontact type shaft seal 13 has a rotating part 13*a* which rotates along with the rotation of the rotor 9 and a fixed part 13*b* which does not rotate. There is a clearance between the rotating part 13*a* and the fixed part 13*b* (see FIG. 3). That is, the shaft seal 13 does not completely block the action of the gas circulating between the gas blowing part 2 and the motor part 3.

For this reason, the casing 5 of the motor part 3 is formed with an exhaust port 5*b* and, during rotation of the impeller 1, the inside space of the casing 5 of the motor part 3 is constantly evacuated from the exhaust port 5*b*. As a result, the pressure inside the motor part 3 is maintained lower than the pressure inside the gas blowing part 2. Due to this, the problem of the oil inside the motor part 3 entering the gas blowing part 2 and being dispersed by the impeller 1 inside the gas laser oscillator no longer arises.

Figure 15:
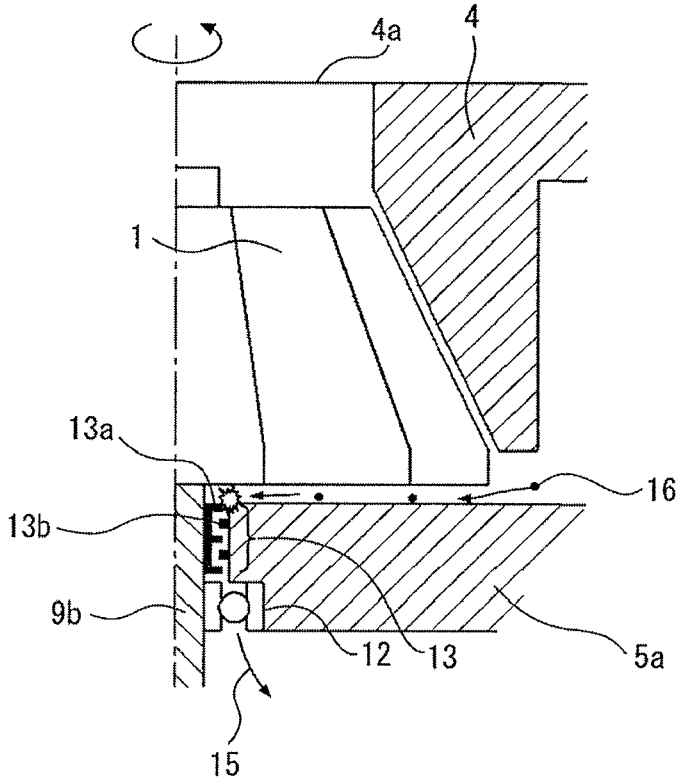
FIG. 15 is a partial cross-sectional view of the surroundings of a shaft seal in a conventional blower.

However, by evacuating the inside space of the motor part 3 so that the pressure inside the motor part 3 becomes lower than the pressure inside the gas blowing part 2, a flow of gas 15 from the gas blowing part 2 toward the inside of the motor part 3 is generated. In particular, part of the gas inside the gas blowing part 2 flows through the clearance between the partition wall part 5*a* and the impeller 1 and flows from the clearance present at the shaft seal 13 to the inside of the motor part 3. At this time, if particle-like foreign matter 16 is generated inside the gas blowing part 2, due to such a flow of gas 15, the foreign matter 16 ends up reaching the clearance of the shaft seal 13 (see FIG. 15). The clearance of the shaft seal 13 is for example about 0.1 mm. The clearance present at the shaft seal 13 is preferably as narrow as possible from the viewpoint of the oil sealing ability. As a result, foreign matter 16 may end up being caught at the clearance present at the shaft seal 13 and the shaft seal 13 may end up being damaged.

For this reason, in the first embodiment, the surface of the partition wall part 5*a* facing the impeller 1 is formed with the groove 20A. Furthermore, as shown in FIG. 2, the groove 20A is a ring-shaped groove which surrounds the shaft seal 13.

Here, the action of the groove 20A will be explained.

Figure 3:
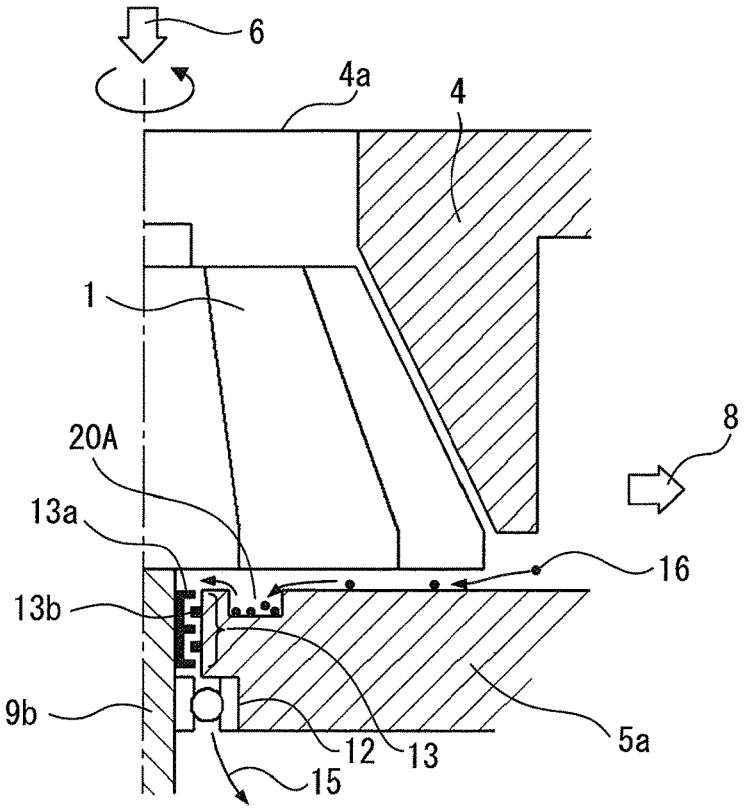
FIG. 3 is a partial cross-sectional view of the surroundings of a shaft seal of a blower in the first embodiment.

FIG. 3 is a partial cross-sectional view of the surroundings of the shaft seal 13 in the blower 100A of the first embodiment and schematically shows a flow of gas 15 heading from the gas blowing part 2 toward the inside of the motor part 3 and the behavior of the foreign matter 16.

When the pressure inside the casing 5 of the motor part 3 is lower than the pressure inside the casing 4 of the gas blowing part 2, a flow of gas 15 such as shown in FIG. 3 is generated. Due to this, part of the gas inside the gas blowing part 2 heads toward the shaft seal 13 and passes through the clearance between the partition wall part 5*a* and the impeller 1. Further, if particle-like foreign matter 16 is generated inside the gas blowing part 2, the foreign matter 16 also moves toward the shaft seal 13 through the clearance between the partition wall part 5*a* and the impeller 1.

At this time, the surface of the partition wall part 5*a* facing the impeller 1 has the groove 20A present so as to cross the path of movement of the foreign matter 16, therefore the foreign matter 16 can be trapped by the groove 20A. In particular, in the first embodiment, by forming the groove 20A into a ring shape, foreign matter 16 which moves toward the shaft seal 13 will always cross the groove 20A. For this reason, the danger of the foreign matter 16 entering the clearance present at the shaft seal 13 can be reduced. As a result, at the blower 100A, the shaft seal 13 is raised in reliability.

Note that, the surface of the partition wall part 5*a* at which the groove 20A is formed is more preferably made perpendicular to the vertical direction. By configuring the blower in this way, foreign matter 16 more easily falls into the groove due to its own weight. Therefore, the probability of the groove 20A trapping the foreign matter 16 can be improved. Such a configuration is also effective for the later explained second embodiment to 10th embodiment.

Second Embodiment

Next, a second embodiment will be explained. Here, only the points differing from the first embodiment will be explained.

Figure 4A:
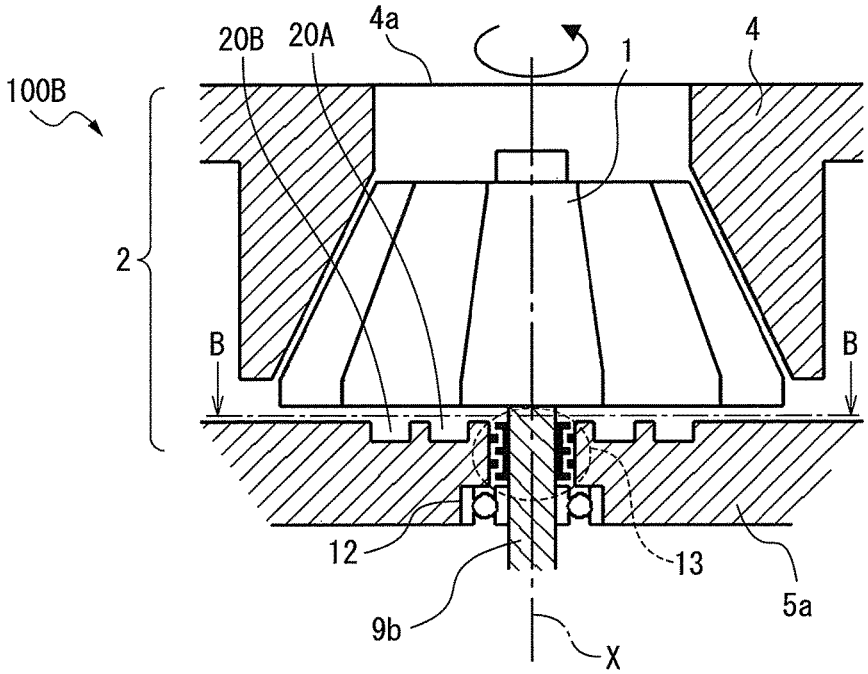
FIG. 4A is a cross-sectional view showing a blower of a second embodiment.
Figure 4B:
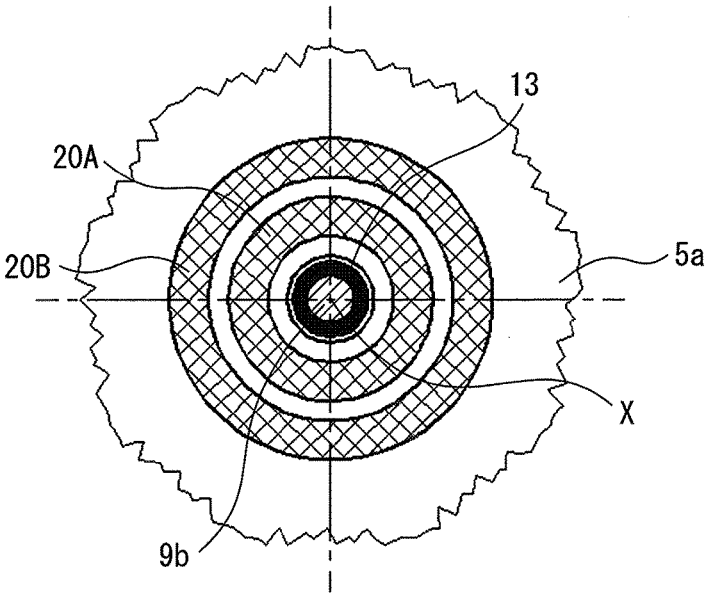
FIG. 4B is a cross-sectional view seen along the line B-B in FIG. 4A.

FIG. 4A is a cross-sectional view showing a blower 100B of the second embodiment. FIG. 4B is a cross-sectional view as seen along the line B-B in FIG. 4A.

In the second embodiment, as shown in FIG. 4A and FIG. 4B, the surface of the partition wall part 5*a* facing the impeller 1 is formed with a plurality of grooves 20A, 20B. The plurality of grooves 20A, 20B are ring-shaped grooves which surround the shaft seal 13. Furthermore, the grooves 20A, 20B are formed into concentric circular shapes about the center axis X.

The rest of the configuration is the same as the first embodiment.

Note that, in FIG. 4B, two ring-shaped grooves 20A, 20B are shown, but the present invention is not limited to this. In addition to the grooves 20A, 20B, at least one ring-shaped groove may be formed so as to surround the shaft seal 13.

In the second embodiment as well, the inside space of the motor part 3 is evacuated so that the pressure inside the motor part 3 becomes lower than the pressure inside the gas blowing part 2. As a result, part of the gas inside the gas blowing part 2 flows through the clearance between the partition wall part 5*a* and the impeller 1 and flows from the clearance present at the shaft seal 13 to the inside of the motor part 3. Further, if particle-like foreign matter 16 is generated inside the gas blowing part 2, the foreign matter 16 sometimes moves toward the shaft seal 13 through the clearance between the partition wall part 5*a* and the impeller 1.

At this time, since the surface of the partition wall part 5*a* facing the impeller 1 has the plurality of grooves 20A, 20B crossing the path of movement of the foreign matter 16, foreign matter 16 is trapped by the plurality of grooves 20A, 20B.

Compared with the first embodiment, the groove 20B was added, therefore the danger of the foreign matter 16 entering the clearance present at the shaft seal 13 can be reduced more. As a result, compared with the first embodiment, the shaft seal 13 is raised in reliability.

Third Embodiment

Next, a third embodiment will be explained. Here, only the points differing from the first embodiment will be explained.

Figure 5A:
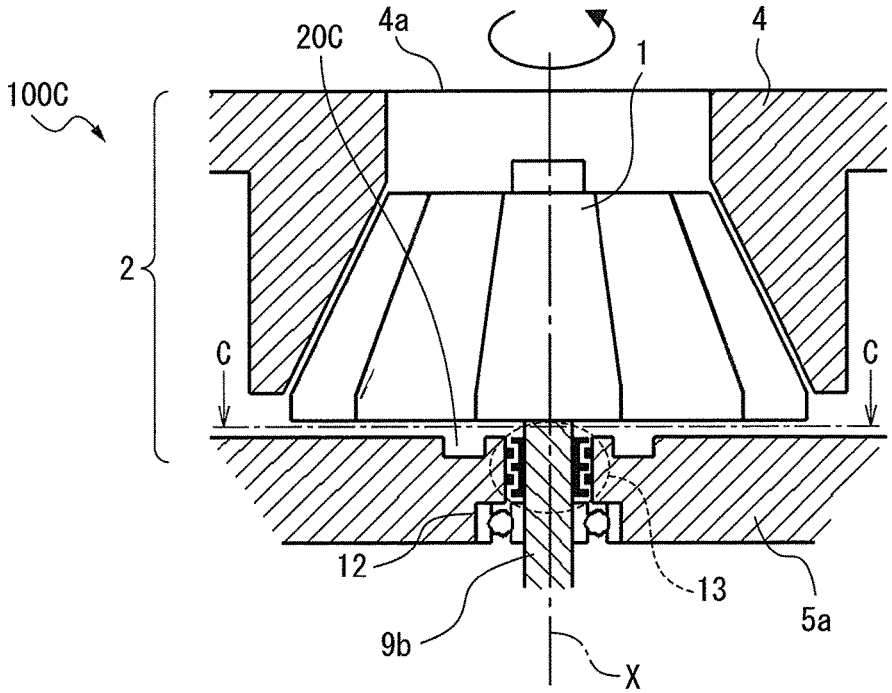
FIG. 5A is a cross-sectional view showing a blower of a third embodiment.
Figure 5B:
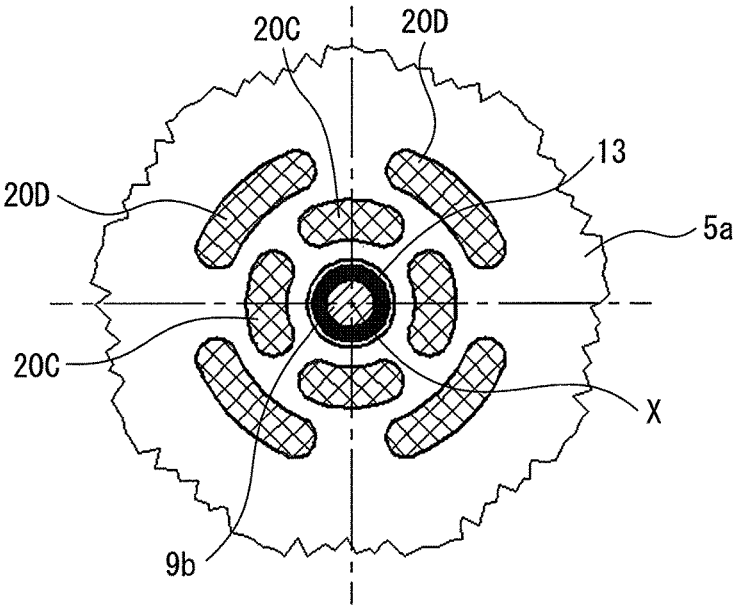
FIG. 5B is a cross-sectional view seen along the line C-C in FIG. 5A.

FIG. 5A is a cross-sectional view showing a blower 100C of the third embodiment. FIG. 5B is a cross-sectional view as seen along the line C-C in FIG. 5A.

In the third embodiment, as shown in FIG. 5A and FIG. 5B, the surface of the partition wall part 5*a* facing the impeller 1 is formed with a plurality of grooves 20C, 20D. The grooves 20C, 20D in the third embodiment are comprised of the ring-shaped grooves 20A, 20B shown in the second embodiment divided into several groove parts.

The rest of the configuration is the same as the first embodiment.

In the third embodiment, the inside space of the motor part 3 is evacuated so that the pressure inside the motor part 3 becomes lower than the pressure inside the gas blowing part 2. As a result, part of the gas inside the gas blowing part 2 flows through the clearance between the partition wall part 5*a* and the impeller 1 and flows from the clearance present at the shaft seal 13 to the inside of the motor part 3. Further, if particle-like foreign matter 16 is generated inside the gas blowing part 2, the foreign matter 16 sometimes moves toward the shaft seal 13 through the clearance between the partition wall part 5*a* and the impeller 1.

At this time, since the surface of the partition wall part 5*a* facing the impeller 1 has the plurality of grooves 20C, 20D crossing the path of movement of the foreign matter 16, foreign matter 16 is trapped by the plurality of grooves 20C, 20D.

Compared with the first embodiment, there are more grooves which trap the foreign matter 16, therefore the danger of the foreign matter 16 entering the clearance present at the shaft seal 13 can be reduced more. As a result, compared with the first embodiment, the shaft seal 13 is raised in reliability. Further, the strength is higher than a structure like in the first embodiment where the ring-shaped grooves 20A, 20B are formed at the partition wall part 5*a*.

Note that, as shown in FIG. 5B, a plurality of grooves 20C are formed at equal intervals in the circumferential direction of a first imaginary circle centered on the center axis X. A plurality of the groove 20D are formed at equal intervals in the circumferential direction of a second imaginary circle centered on the center axis X and larger than the first imaginary circle. Furthermore, seen in the diametrical direction from the center axis X, the plurality of grooves 20C are formed so as to fill the spaces between an adjoining groove 20D and groove 20D. By forming the plurality of grooves 20C, 20D in this way, even if foreign matter 16 passes between an adjoining groove 20D and groove 20D, the foreign matter 16 can be trapped by the groove 20C.

Fourth Embodiment

Next, a fourth embodiment will be explained. Here, only the points differing from the first embodiment will be explained.

Figure 6A:
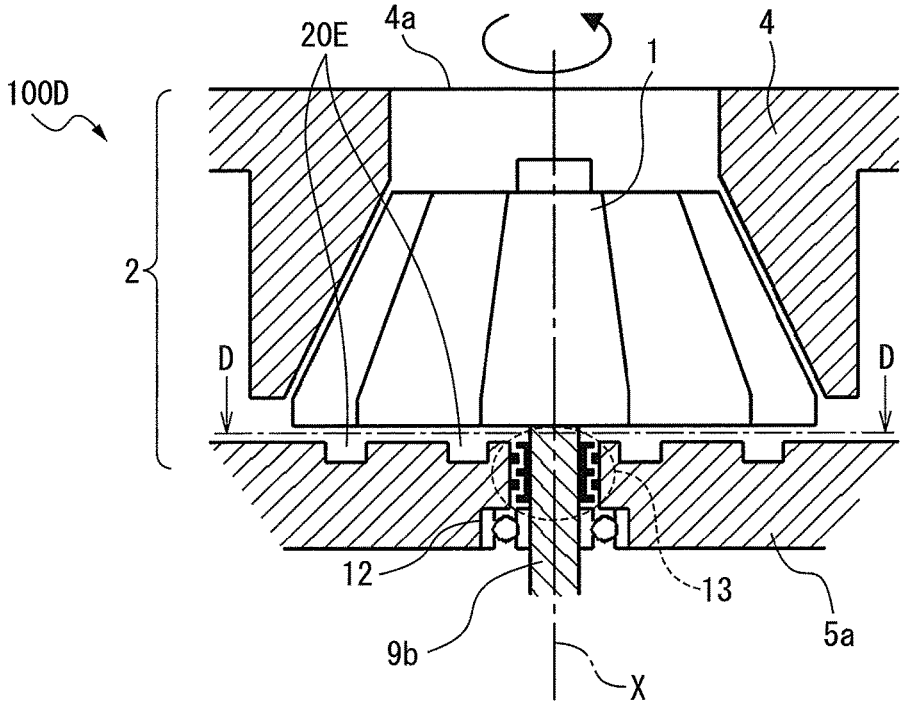
FIG. 6A is a cross-sectional view showing a blower of a fourth embodiment.
Figure 6B:
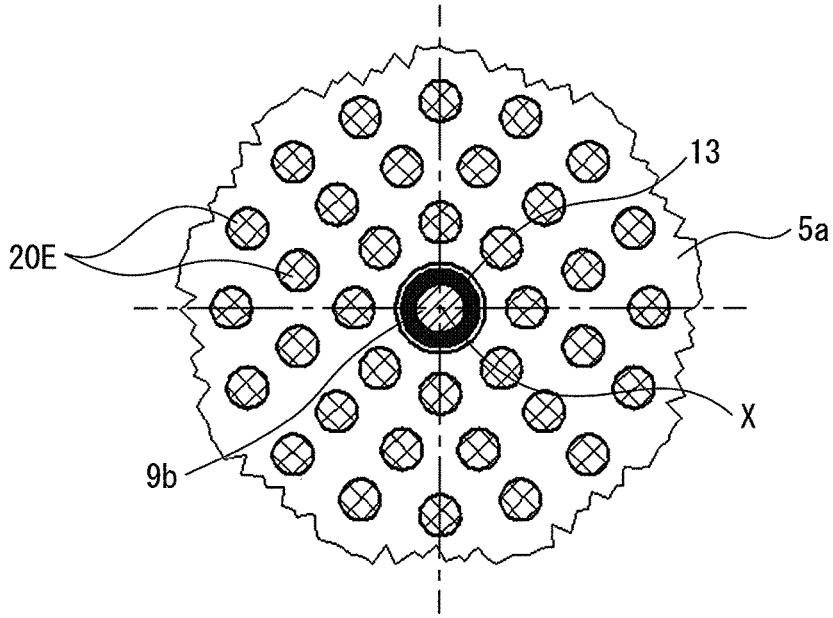
FIG. 6B is a cross-sectional view seen along the line D-D in FIG. 6A.

FIG. 6A is a cross-sectional view showing a blower 100D of the fourth embodiment. FIG. 6B is a cross-sectional view as seen along the line D-D in FIG. 6A.

In the fourth embodiment, as shown in FIG. 6A and FIG. 6B, the surface of the partition wall part 5*a* facing the impeller 1 is formed with a large number of grooves 20E. Furthermore, the grooves 20E are circular recessed parts. They are formed at equal intervals in the circumferential directions of a plurality of imaginary circles centered on the center axis X. The intervals between the imaginary circles are also set to be equal.

The rest of the configuration is the same as the first embodiment.

In the fourth embodiment as well, the inside space of the motor part 3 is evacuated so that the pressure inside the motor part 3 becomes lower than the pressure inside the gas blowing part 2. As a result, part of the gas inside the gas blowing part 2 flows through the clearance between the partition wall part 5*a* and the impeller 1 and flows from the clearance present at the shaft seal 13 to the inside of the motor part 3. Further, if particle-like foreign matter 16 is generated inside the gas blowing part 2, the foreign matter 16 sometimes moves toward the shaft seal 13 through the clearance between the partition wall part 5*a* and the impeller 1.

At this time, since the surface of the partition wall part 5*a* facing the impeller 1 is formed with a large number of grooves 20E uniformly scattered with respect to the path of movement of foreign matter 16, the foreign matter 16 is trapped by the large number of grooves 20E.

Compared to the first embodiment, there are more grooves which trap foreign matter 16, therefore the danger of the foreign matter 16 entering the clearance present at the shaft seal 13 can be reduced more. As a result, compared with the first embodiment, the shaft seal 13 is raised in reliability.

Fifth Embodiment

Next, a fifth embodiment will be explained. Here, only the points differing from the first embodiment will be explained.

Figure 7A:
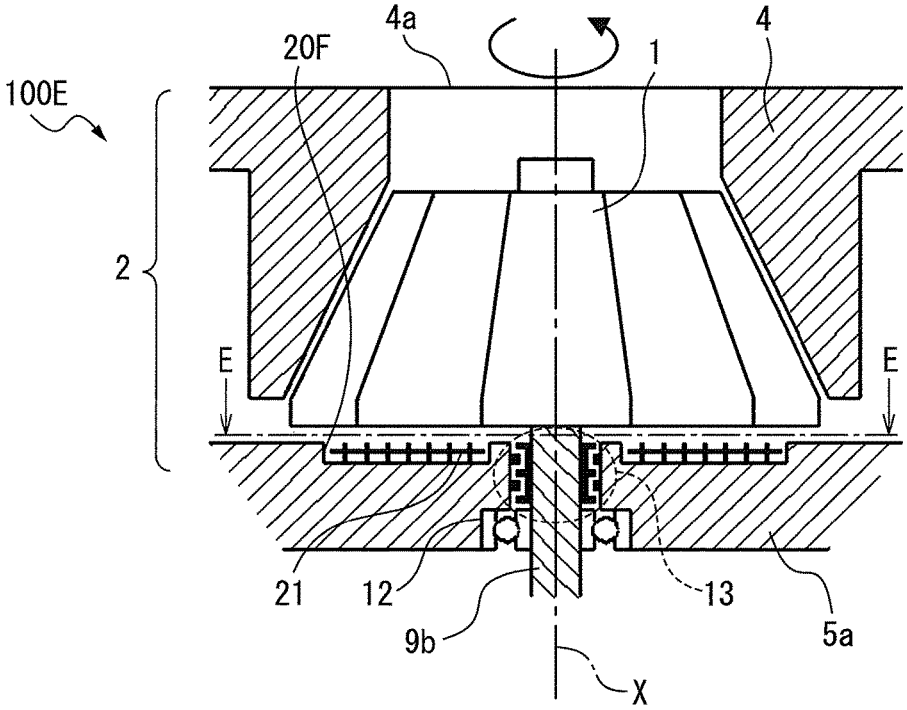
FIG. 7A is a cross-sectional view showing a blower of a fifth embodiment.
Figure 7B:
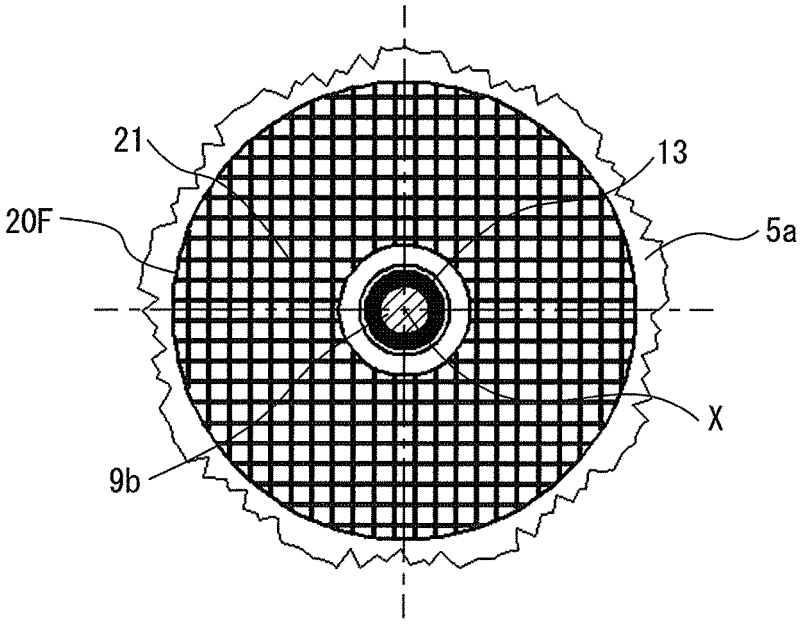
FIG. 7B is a cross-sectional view seen along the line E-E in FIG. 7A.

FIG. 7A is a cross-sectional view showing a blower 100E of the fifth embodiment. FIG. 7B is a cross sectional view as seen along the line E-E in FIG. 7A.

In the fifth embodiment, as shown in FIG. 7A and FIG. 7B, a grid part 21 is arranged at the surface of the partition wall part 5*a* facing the impeller 1. Furthermore, the surface of the partition wall part 5*a* facing the impeller 1 is formed with a single groove 20F for holding the grid part 21. The groove 20F is formed in a ring shape about the center axis X. The rest of the configuration is the same as the first embodiment.

In the fifth embodiment as well, the inside space of the motor part 3 is evacuated so that the pressure inside the motor part 3 becomes lower than the pressure inside the gas blowing part 2. As a result, part of the gas inside the gas blowing part 2 flows through the clearance between the partition wall part 5*a* and the impeller 1 and flows from the clearance present at the shaft seal 13 to the inside of the motor part 3. Further, if particle-like foreign matter 16 is generated inside the gas blowing part 2, the foreign matter 16 sometimes moves toward the shaft seal 13 through the clearance between the partition wall part 5*a* and the impeller 1.

At this time, the surface of the partition wall part 5*a* facing the impeller 1 has the groove 20F holding the grid part 21, therefore the foreign matter 16 is trapped by the large number of mesh parts of the grid part 21.

Compared with the first embodiment, the large number of mesh parts can trap the foreign matter 16, therefore the danger of the foreign matter 16 entering the clearance present at the shaft seal 13 can be reduced more. As a result, compared with the first embodiment, the shaft seal 13 is raised in reliability. Note that, it is also possible that the groove 20F not be formed at the partition wall part 5*a* and that the grid part 21 be arranged between the impeller 1 and the partition wall part 5*a*.

Sixth Embodiment

Next, a sixth embodiment will be explained. Here, only the points differing from the first embodiment will be explained.

Figure 8:
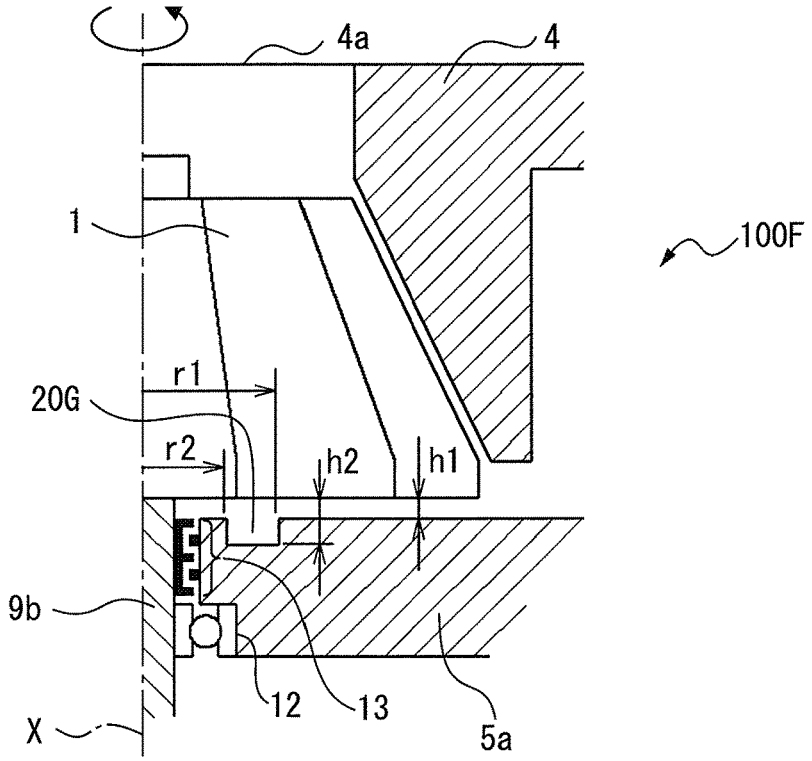
FIG. 8 is a cross-sectional view showing a blower of a sixth embodiment.

FIG. 8 is a cross-sectional view showing a blower 100F of the sixth embodiment.

In the sixth embodiment, as shown in FIG. 8, the surface of the partition wall part 5*a* facing the impeller 1 is formed with the groove 20G. The groove 20G, like in the first embodiment, is a ring-shaped groove which surrounds the shaft seal 13. Furthermore, the groove 20G, like in the first embodiment, is formed in a concentric circle about the center axis X (see FIG. 2).

Furthermore, in the sixth embodiment, the groove 20G is formed so as to satisfy the relationships of $r2<r1$, $h1<h2$, and $r1 \cdot h1<r2 \cdot h2$.

Here, r1 is the distance between the axis of rotation X and the side surface of the ring-shaped groove 20G at the outer circumference side. r2 is the distance between the axis of rotation X and the side surface of the ring-shaped groove 20G at the inner circumference side. h1 is the distance between the impeller 1 and the partition wall part 5*a*. Further, h2 is the distance between the surface of the impeller 1 facing the partition wall part 5*a* and the bottom surface of the groove 20G.

The rest of the configuration is the same as the first embodiment.

In the sixth embodiment as well, the pressure inside the motor part 3 is made to become lower than the pressure inside the gas blowing part 2 by evacuating the inside space of the motor part 3. As a result, part of the gas inside the gas blowing part 2 flows through the clearance between the partition wall part 5*a* and the impeller 1 to flow from the clearance present at the shaft seal 13 to the inside of the motor part 3. Further, when particle-like foreign matter 16 has been generated inside the gas blowing part 2, the foreign matter 16 sometimes move toward the shaft seal 13 through the clearance between the partition wall part 5*a* and the impeller 1.

At this time, the clearance between the partition wall part 5*a* and the impeller 1 becomes greater at the location where the groove 20G is formed compared with other locations. As a result, the flow rate of the gas at the groove 20G becomes slower than the flow rate of the gas passing through the clearance between the partition wall part 5*a* and the impeller 1. Therefore, when foreign matter 16 moves through the clearance between the partition wall part 5*a* and the impeller 1, the foreign matter 16 easily enters inside the groove 20G.

To sufficiently obtain the above action and make it difficult for the foreign matter 16 to reach the shaft seal 13, it is desirable that the gas channel area which the groove bottom surface and impeller form at the groove inner circumference side downstream in the flow of gas ($2\pi \cdot r2 \cdot h2$) be made larger than the gas channel area which the partition wall part and impeller form at the groove outer circumference side upstream in the flow of gas ($2\pi \cdot r1 \cdot h1$).

For this reason, the groove 20G should be formed so as to satisfy the relationships of $r2<r1$, $h1<h2$, and $r1 \cdot h1<r2 \cdot h2$.

Note that, in the sixth embodiment, the example was shown of application of the above relationships to the groove 20G formed in the same way as in the first embodiment. However, the above relationships can also be applied to at least one groove explained in the second embodiment and the third embodiment.

Seventh Embodiment

Next, a seventh embodiment will be explained. Here, only the points differing from the first embodiment will be explained.

Figure 9:
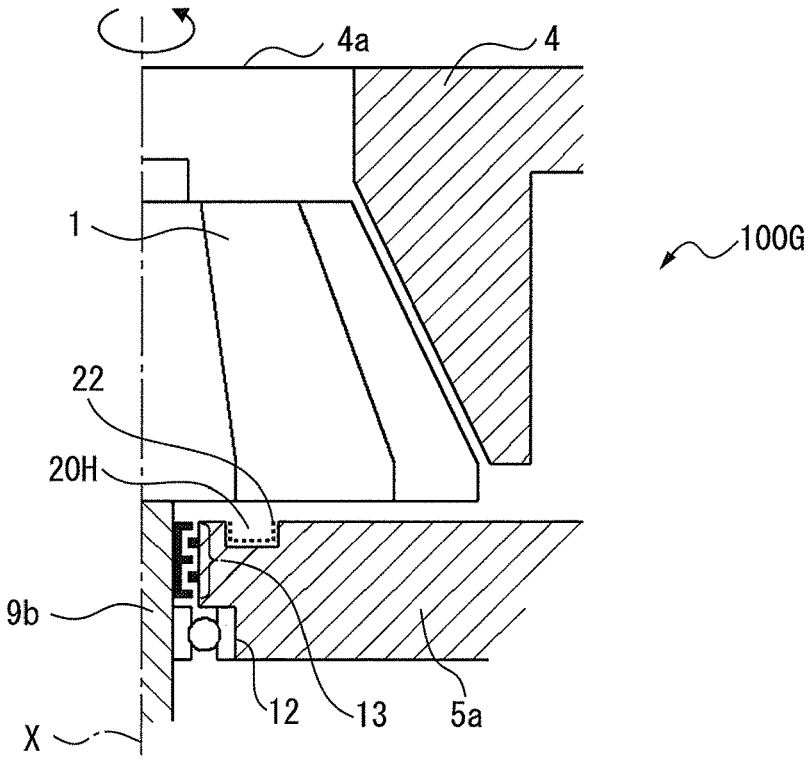
FIG. 9 is a cross-sectional view showing a blower of a seventh embodiment.

FIG. 9 is a cross-sectional view showing a blower 100G of the seventh embodiment.

In the seventh embodiment, as shown in FIG. 9, the surface of the partition wall part 5*a* facing the impeller 1 is formed with the groove 20H. The groove 20H is formed like in the first embodiment. That is, the groove 20H is a ring-shaped groove which surrounds the shaft seal 13.

Furthermore, in the seventh embodiment, an adhesive 22 is arranged at the inside wall surface of the groove 20H. The rest of the configuration is the same as the first embodiment.

In the seventh embodiment as well, the inside space of the motor part 3 is evacuated so that the pressure inside the motor part 3 becomes lower than the pressure inside the gas blowing part 2. As a result, part of the gas inside the gas blowing part 2 flows through the clearance between the partition wall part 5*a* and the impeller 1 and flows from the clearance present at the shaft seal 13 to the inside of the motor part 3. Further, if particle-like foreign matter 16 is generated inside the gas blowing part 2, the foreign matter 16 sometimes moves toward the shaft seal 13 through the clearance between the partition wall part 5*a* and the impeller 1.

At this time, the surface of the partition wall part 5*a* facing the impeller 1 has the groove 20H present so as to cross the path of movement of the foreign matter 16, therefore the foreign matter 16 enters the inside of the groove 20H. Furthermore, the adhesive 22 is arranged at the inside wall surface of the groove 20H, therefore the foreign matter 16 which enters the groove 20H is reliably trapped by the adhesive 22.

Since the foreign matter 16 is reliably trapped by the adhesive 22, compared with the first embodiment, the danger of the foreign matter 16 entering the clearance present at the shaft seal 13 can be reduced more. As a result, compared with the first embodiment, the shaft seal 13 is raised in reliability.

Note that, in the seventh embodiment, the example was shown where a groove 20H formed like in the first embodiment had an adhesive 22 applied to it. However, the adhesive 22 may also be arranged at the inside wall surface of the grooves explained in the second embodiment to the sixth embodiment.

Eighth Embodiment

Next, an eighth embodiment will be explained. Here, only the points differing from the first embodiment will be explained.

Figure 10:
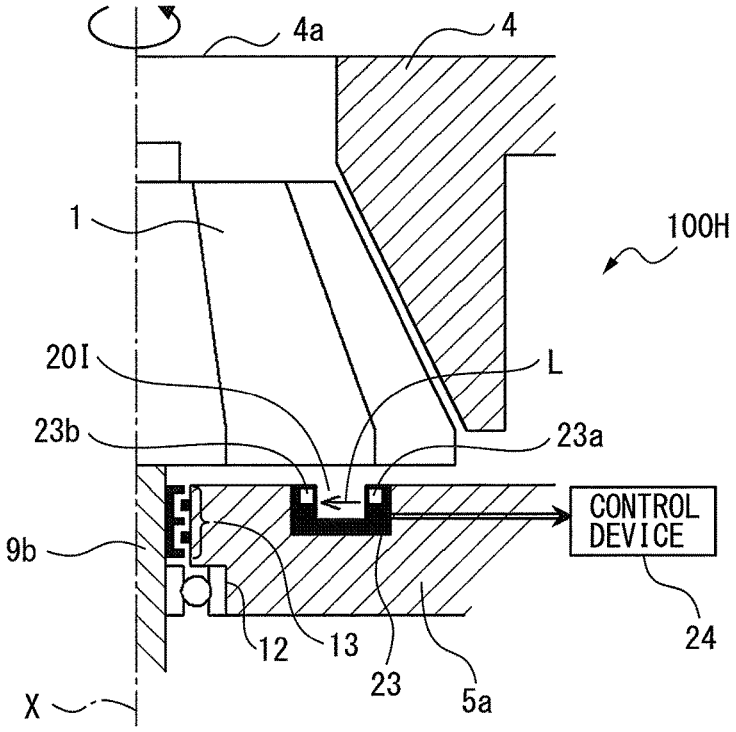
FIG. 10 is a cross-sectional view showing a blower of an eighth embodiment.

FIG. 10 is a cross-sectional view showing a blower 10H of the eighth embodiment.

In the eighth embodiment, as shown in FIG. 10, the surface of the partition wall part 5*a* facing the impeller 1 is formed with a groove 20I. The groove 20I is formed like in the first embodiment. That is, the groove 20I is a ring-shaped groove which surrounds the shaft seal 13.

Furthermore, in the eighth embodiment, a transmission type photocoupler 23 is arranged in the inside of the groove 20I. The blower 100H is provided with a control device 24 which controls the operation of the blower 100H based on a signal which is output from the transmission type photocoupler 23.

The transmission type photocoupler 23 is provided with a light emitting part 23*a* and a light receiving part 23*b* which receives the light L from the light emitting part 23*a*. The light emitting part 23*a* of the photocoupler 23 is fastened to one side of the groove 20I, the light receiving part 23*b* of the photocoupler 23 is fastened to the other side of the groove 20I. When the light L heading from the light emitting part 23*a* to the light receiving part 23*b* as shown in FIG. 10 is broken, the photocoupler 23 sends a signal to the control device 24. Furthermore, the light emitting part 23*a* and light receiving part 23*b* of the photocoupler 23 are arranged at a predetermined height from the bottom surface of the groove 20I. The rest of the configuration is the same as the first embodiment.

In the eighth embodiment as well, the inside space of the motor part 3 is evacuated so that the pressure inside the motor part 3 becomes lower than the pressure inside the gas blowing part 2. As a result, part of the gas inside the gas blowing part 2 flows through the clearance between the partition wall part 5*a* and the impeller 1 and flows from the clearance present at the shaft seal 13 to the inside of the motor part 3. Further, if particle-like foreign matter 16 is generated inside the gas blowing part 2, the foreign matter 16 also moves toward the shaft seal 13 through the clearance between the partition wall part 5*a* and the impeller 1.

At this time, since the surface of the partition wall part 5*a* facing the impeller 1 has the groove 20I present so as to cross the path of movement of the foreign matter 16, the foreign matter 16 enters the inside of, the groove 20I.

Further, when a large amount of foreign matter 16 builds up in the groove 20I and reaches a predetermined amount or height, the light L of the photocoupler 23 is broken and the photocoupler 23 sends the control device 24 a signal. Due to this, for example, the control device 24 makes the rotation of the rotor 9 stop and outputs an alarm prompting the user to remove the foreign matter 16.

In this way, a predetermined amount of foreign matter 16 building up inside the groove 20I can be detected, therefore compared with the first embodiment, the danger of the foreign matter 16 entering the clearance present at the shaft seal 13 can be reduced more. As a result, compared with the first embodiment, the shaft seal 13 is raised in reliability.

Note that, in the eighth embodiment, an example was shown of application of a transmission type photocoupler 23 to a groove formed like in the first embodiment. However, the transmission type photocoupler 23 may also be applied to any of the grooves explained in the second embodiment to the seventh embodiment.

Ninth Embodiment

Next, a ninth embodiment will be explained. Here, only the points differing from the first embodiment will be explained.

Figure 11:
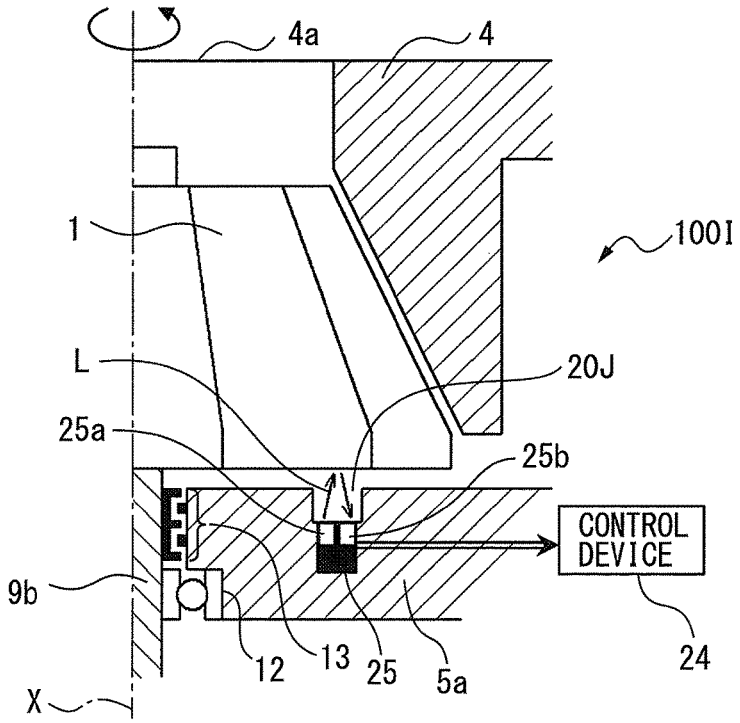
FIG. 11 is a cross-sectional view showing a blower of a ninth embodiment.

FIG. 11 is a cross-sectional view showing a blower 100I of the ninth embodiment.

In the ninth embodiment, as shown in FIG. 11, the surface of the partition wall part 5*a* facing the impeller 1 is formed with a groove 20J. The groove 20J is formed like in the first embodiment. That is, the groove 20J is a ring-shaped groove which surrounds the shaft seal 13.

Furthermore, in the ninth embodiment, a reflection type photocoupler 25 is arranged at the bottom part of the groove 20J. The blower 100I is provided with a control device 24 which controls the operation of the blower 100I based on a signal which is output from the reflection type photocoupler 25.

The reflection type photocoupler 25 is provided with a light emitting part 25*a* which emits light from the bottom part of the groove 20J toward the impeller 1 and a light receiving part 25*b* which receives the light L. When the light L which returns from the light emitting part 25*a* to the light receiving part 25*b* as shown in FIG. 11 can no longer be detected by the light receiving part 25*b*, the photocoupler 25 sends a signal to the control device 24.

Furthermore, in the reflection type photocoupler 25, the sensitivity of the light receiving part 25*b*, that is, the amount of light L which the light receiving part 25*b* can detect, can be adjusted. The more the amount of foreign matter 16 which builds up at the bottom part of the groove 20J increases, the more the amount of light L which returns from the light emitting part 25*a* to the light receiving part 25*b* decreases. Therefore, by setting the amount of light L which the light receiving part 25*b* can detect, it is possible to sense if the foreign matter 16 inside the groove 20J has reached a predetermined amount or height.

The rest of the configuration is the same as the first embodiment.

In the ninth embodiment as well, the inside space of the motor part 3 is evacuated so that the pressure inside the motor part 3 becomes lower than the pressure inside the gas blowing part 2. As a result, part of the gas inside the gas blowing part 2 flows through the clearance between the partition wall part 5*a* and the impeller 1 and flows from the clearance present at the shaft seal 13 to the inside of the motor part 3. Further, if particle-like foreign matter 16 is generated inside the gas blowing part 2, the foreign matter 16 sometimes moves toward the shaft seal 13 through the clearance between the partition wall part 5*a* and the impeller 1.

At this time, since the surface of the partition wall part 5*a* facing the impeller 1 has the groove 20J present so as to cross the path of movement of the foreign matter 16, the foreign matter 16 enters inside the groove 20J.

Further, when a large amount of foreign matter 16 builds up inside the groove 20J and reaches a predetermined amount or height, the light L returned from the light emitting part 25*a* to the light receiving part 25*b* of the photocoupler 25 can no longer be detected by the light receiving part 25*b*, and the photocoupler 25 sends a signal to the control device 24. Due to this, for example, the control device 24 makes the rotation of the rotor 9 stop and outputs an alarm prompting the user to remove the foreign matter 16.

Since a predetermined amount of foreign matter 16 building up inside the groove 20J can be detected in this way, compared with the first embodiment, the danger of the foreign matter 16 entering the clearance present at the shaft seal 13 can be reduced more. As a result, compared with the first embodiment, the shaft seal 13 is raised in reliability.

Note that, in the ninth embodiment, an example was shown of application of a reflection type photocoupler 25 to a groove 20J formed like in the first embodiment. However, the reflection type photocoupler 25 may also be applied to any of the grooves explained in the second embodiment to the seventh embodiment.

10th Embodiment

Next, a 10th embodiment will be explained. Here, only the points differing from the first embodiment will be explained.

Figure 12:
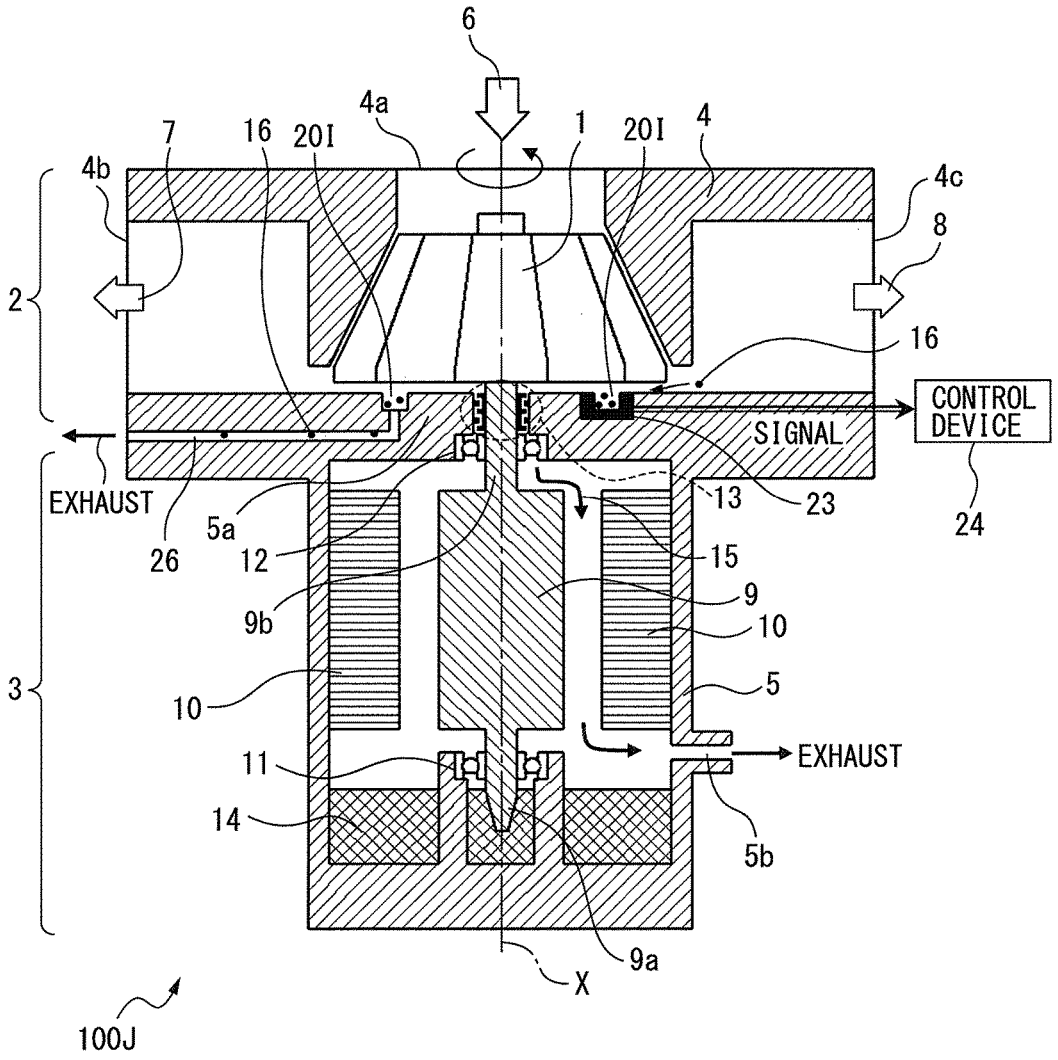
FIG. 12 is a cross-sectional view showing a blower of a 10th embodiment.

FIG. 12 is a cross-sectional view showing a blower 100J of the 10th embodiment.

The 10th embodiment is comprised of the groove 20I explained in the eighth embodiment (see FIG. 10) to which a foreign matter discharge structure for discharging foreign matter 16 from the groove 20I is provided. This foreign matter discharge structure, as shown in FIG. 12, has a discharge path 26 which discharges foreign matter 16 inside the groove 20I to the outside of the blower 100J. The discharge path 26 is formed from the bottom part of the groove 20I to the outside of the blower 100J through the inside of the partition wall part 5*a* which partitions the gas blowing part 2 from the motor part 3. Furthermore, the outlet of the discharge path 26 is connected to an exhaust device, for example, an exhaust pump (not shown).

In the 10th embodiment as well, the inside space of the motor part 3 is evacuated so that the pressure inside the motor part 3 becomes lower than the pressure inside the gas blowing part 2. As a result, part of the gas inside the gas blowing part 2 flows through the clearance between the partition wall part 5*a* and the impeller 1 and flows from the clearance present at the shaft seal 13 to the inside of the motor part 3. Further, if particle-like foreign matter 16 is generated inside the gas blowing part 2, the foreign matter 16 sometimes moves toward the shaft seal 13 through the clearance between the partition wall part 5*a* and the impeller 1.

At this time, the surface of the partition wall part 5*a* facing the impeller 1 has the groove 20I present so as to cross the path of movement of the foreign matter 16, so the foreign matter 16 enters inside the groove 20I.

Further, when a large amount of foreign matter 16 builds up inside the groove 20I and reaches a predetermined amount or height, the light L of the photocoupler 23 is broken and the photocoupler 23 sends a signal to the control device 24. Due to this, the control device 24 makes the exhaust pump (not shown) operate. The exhaust pump is used to exhaust the air inside the discharge path 26, so the foreign matter 16 present inside the groove 20I also passes through the discharge path 26 and is discharged to the outside of the blower 100J.

In this way, it is possible to detect a predetermined amount of foreign matter 16 building up inside the groove 20I and discharge the foreign matter 16 inside the groove 20I to the outside of the blower 100J, therefore compared with the first embodiment, the danger of the foreign matter 16 entering the clearance present at the shaft seal 13 can be reduced more. As a result, compared with the first embodiment, the shaft seal 13 is raised in reliability.

Furthermore, compared with the eighth embodiment, the foreign matter 16 which builds up inside the groove 20I can be removed more easily. Further, by connecting an exhaust pump to the discharge path 26, there is no longer a need to stop the blower 100J and have the user remove the foreign matter 16 in the groove 20I.

Note that, in the 10th embodiment, the example was shown of applying the foreign matter discharge structure to the groove 20I formed in the same way as the eighth embodiment. However, the foreign matter discharge structure may also be applied to any of the grooves explained in the first embodiment to the seventh embodiment and the ninth embodiment.

Figure 13:
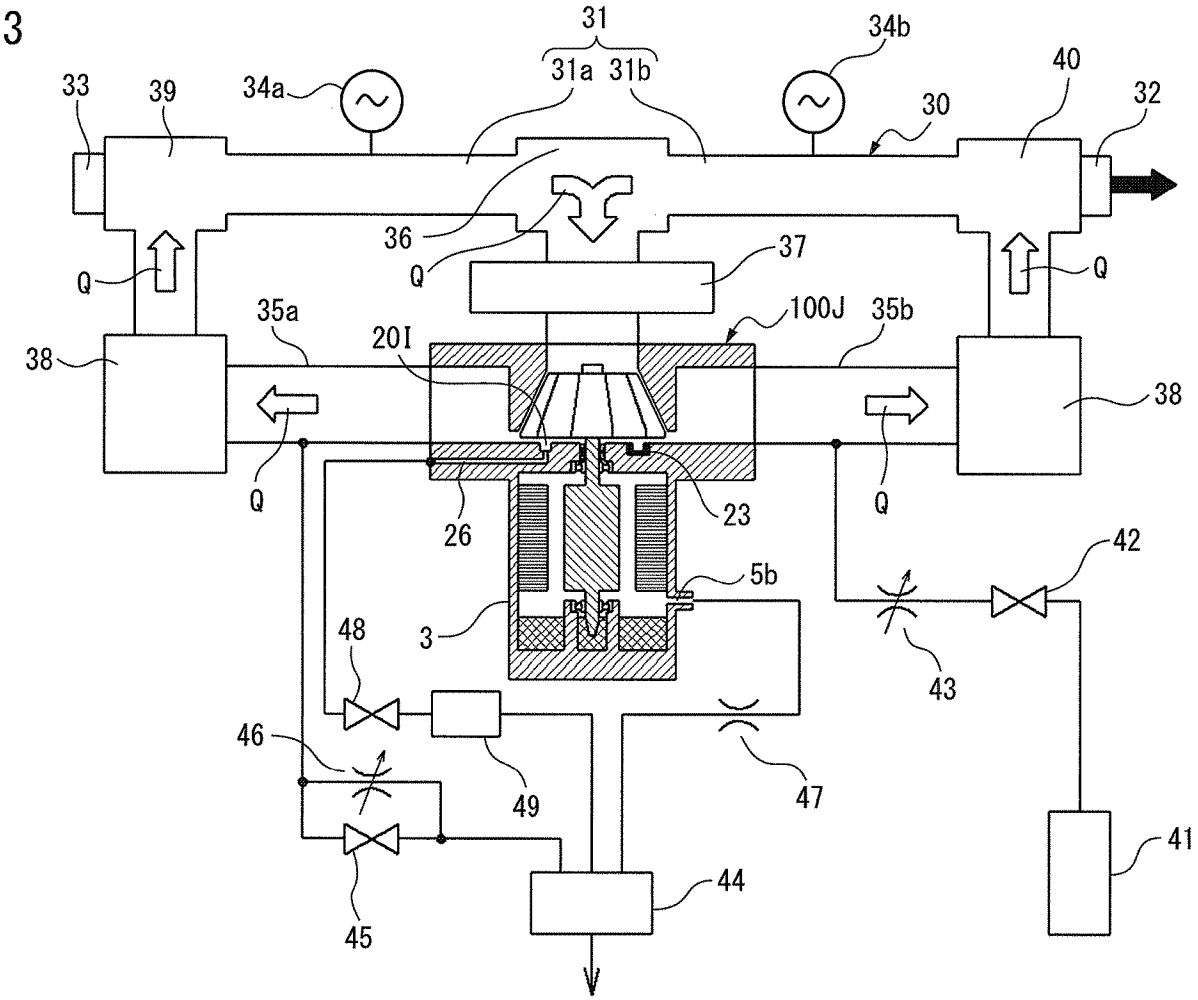
FIG. 13 is a schematic view showing a gas laser oscillator to which the blower shown in FIG. 12 is applied.

Next, a gas laser oscillator which applies the blower 100J of the 10th embodiment will be explained. FIG. 13 is a schematic view showing a gas laser oscillator to which the blower 100J shown in FIG. 12 is applied.

The gas laser oscillator shown in FIG. 13 is provided with a resonator part 30 for making the laser light to be output resonate. The resonator part 30 has an axial type discharge part 31 which holds the laser gas and uses discharge to excite the laser gas and discharge laser light. The laser gas is, for example, a mixed gas mainly comprised of carbon dioxide, nitrogen, and helium. This discharge part 31, for example, is configured by connecting two discharge tubes 31*a*, 31*b* in series.

At positions of the discharge part 31 forming the two ends in the axial direction, an output coupler (partially reflecting mirror) 32 and rear mirror (total reflection mirror) 33 are arranged. The output coupler 32 and rear mirror 33 are positioned with a high precision.

The discharge tubes 31*a*, 31*b* are respectively connected to high frequency power sources 34*a*, 34*b*. By applying the high frequency power from the high frequency power sources 34*a*, 34*b* across the electrodes in the discharge tubes 31*a*, 31*b*, the laser gas between the electrodes inside the discharge tubes 31*a*, 31*b* is made to discharge. If exciting the laser gas by discharge, laser light is discharged in the long axis directions of the discharge tubes 31*a*, 31*b*. This laser light is repeatedly reflected and amplified between the output coupler 32 and the rear mirror 33 and passes through the output coupler 32 to be output to the outside of the resonator part 30. The output laser light is utilized for metalworking or plastic working etc.

The discharge tubes 31*a*, 31*b* are respectively connected to the laser gas channels 35*a*, 35*b*. The laser gas channel 35*a* is the channel from the connecting part 36 connecting the discharge tubes 31*a*, 31*b* through the first heat exchanger 37, blower 100J, and second heat exchanger 38 to one end part 39 of the discharge part 31. On the other hand, the laser gas channel 35*b* is the channel from the connecting part 36 of the discharge tubes 31*a*, 31*b* through the first heat exchanger 37, blower 100J, and second heat exchanger 38 and reaching the other end part 30 of the discharge part 31. Note that, in FIG.

13, to facilitate understanding of the direction of flow of the laser gas, white arrows Q are drawn inside the laser gas channels 35*a*, 35*b*.

Further, the laser gas channel 35*b* is connected to a gas tank 41 in which the laser gas is filled. The channel connecting the gas tank 41 and the laser channel 35*b* is provided with a check valve 42 and flow regulating valve 43. As opposed to this, the laser gas channel 35*a* is connected to the exhaust pump 44. The channel connecting the exhaust pump 44 and the laser channel 35*a* is provided with a check valve 45 and flow regulating valve 46.

In the laser gas channels 35*a*, 35*b*, by operating the blower 100J, the laser gas inside the discharge tubes 31*a*, 31*b* is discharged from the discharge tubes 31*a*, 31*b* and cooled by the first heat exchanger 37. Furthermore, the laser gas which passes through the first heat exchanger 37 is returned by the blower 100J to the insides of the discharge tubes 31*a*, 31*b*. When passing through the blower 100J, the laser gas is compressed and the laser gas rises in temperature. For this reason, the laser gas which passes through the blower 100J is cooled by the second heat exchanger 38. Due to the above configuration, the laser gas inside the discharge tubes 31*a*, 31*b* is circulated by the laser gas channels 35*b*, 35*b* while cooling the laser gas.

Furthermore, the exhaust port 5*b* for evacuating the inside space of the motor part 3 of the blower 100J is connected to the above-mentioned exhaust pump 44. The channel connecting the exhaust port 5*b* and the exhaust pump 44 is provided with a flow control valve 47 comprised of a fixed orifice. The flow control valve 47 controls the exhaust flow rate so that the lubrication oil inside the motor part 3 is not exhausted from the exhaust port 5*b*.

The discharge path 26 which discharges the foreign matter 16 is also connected to the exhaust pump 44. Further, the channel connecting the exhaust path 26 and the exhaust pump 44 is provided with a check valve 48 and a filter 49. Due to the filter 49, the foreign matter 16 which was discharged from the discharge path 26 is prevented from entering the exhaust pump 44.

Note that, in the gas laser oscillator shown in FIG. 13, any of the blowers explained in the first embodiment to the ninth embodiment may be applied instead of the blower 100J of the 10th embodiment.

Above, the present invention was explained with reference to the example of a blower which can be applied to a gas laser oscillator, but the blower of the present invention is not limited to application to a gas laser oscillator and can also be applied to a compressor, gas turbine, or vacuum pump.

Further, in the above-mentioned embodiments, the example was shown of a blower evacuating the inside space of the motor part 3 so that the pressure inside the motor part 3 becomes lower than the pressure inside the gas blowing part 2, but the present invention is not limited to one requiring evacuation of the inside of the motor part 3. That is, the present invention can be applied to all ones which are provided with structures arranging noncontact type shaft seals between the shaft parts and through holes through which the shaft parts pass and which, due to such structures, have the possibility of the gas flowing to the clearances of such shaft seals.

Advantageous Effects of the Invention

According to the first aspect of the present invention, a noncontact type shaft seal is arranged at the through hole of the partition wall part through which one end part of the rotor passes, therefore part of the gas inside the gas blowing part passes through a clearance present at the noncontact type shaft seal and flows inside of the motor part. For this reason, when particle-like foreign matter is generated inside the gas blowing part, the foreign matter will sometimes move toward the shaft seal through the clearance between the partition wall part and impeller along with the flow of gas. At this time, since the surface of the partition wall part facing the impeller is formed with a groove, foreign matter can be trapped by the groove. Due to this, the danger of foreign matter entering a clearance present at the shaft seal can be reduced. Therefore, in the blower, the shaft seal is raised in reliability.

According to the second aspect of the present invention, by forming the groove which can trap foreign matter in a ring shape so as to surround the shaft seal as explained above, foreign matter which moves toward the shaft seal always will cross the groove. For this reason, the danger of foreign matter entering the clearance present at the shaft seal is reduced.

According to the third aspect of the present invention, by forming the ring-shaped groove so as to satisfy the relationships of $r2<r1$, $h1<h2$, and $r1 \cdot h1<r2 \cdot h2$, foreign matter which moves toward the shaft seal easily enters the groove and has more difficulty reaching the shaft seal.

That is, since the surface of the partition wall part facing the impeller is formed with the groove, the location where the groove is formed becomes larger in clearance between the partition wall part and the impeller than the other locations. As a result, the flow rate of the gas at the groove also becomes slower than the flow rate of the gas passing through the clearance between the partition wall part and the impeller. Therefore, when foreign matter moves through the clearance between the partition wall part and impeller, the foreign matter easily enters the groove. To sufficiently obtain this action and make it harder for foreign matter to reach the shaft seal, it is necessary to make the gas channel area which the groove bottom surface and impeller form at the groove inner circumference side downstream in the flow of gas ($2\pi \cdot r2 \cdot h2$) larger than the gas channel area which the partition wall part and impeller form at the groove outer circumference side upstream in the flow of gas ($2\pi \cdot r1 \cdot h1$). This can be achieved by forming the ring-shaped groove so as to satisfy the above-mentioned relationships of $r2<r1$, $h1<h2$, and $r1 \cdot h1<r2 \cdot h2$.

According to the fourth aspect of the present invention, by forming a plurality of grooves able to trap foreign matter as explained above, it is possible to reduce more the damage of foreign matter entering the clearance in the shaft seal.

According to the fifth aspect of the present invention, by arranging an adhesive inside the groove able to trap foreign matter as explained above, the adhesive enables the foreign matter to be more reliably trapped.

According to the sixth aspect of the present invention, a predetermined amount of foreign matter building up inside the groove can be detected, therefore the user can be prompted to remove the foreign matter inside the groove.

According to the seventh aspect of the present invention, a discharge path for discharging foreign matter which builds up inside the groove is formed in the partition wall part, therefore it is possible to easily remove foreign matter which has built up inside of the groove. Further, if connecting ab exhaust pump to the discharge path, it is no longer necessary to stop the blower and have the user remove the foreign matter inside the groove.

According to the eighth aspect of the present invention, by making the surface of the partition wall part at which the groove is formed perpendicular to the vertical direction, foreign matter which moves over the surface at which the groove is formed more easily falls into the groove due to its own weight. For this reason, the probability of the groove trapping the foreign matter can be improved.

According to the ninth aspect of the present invention, by forming an exhaust port which evacuates the inside space of the motor part, the pressure inside the motor part can be made lower than the pressure inside the gas blowing part. Due to this, in a system which supplies lubrication oil to the bearing part of the rotor inside the motor part, the problem of the oil entering the gas blowing part and being dispersed no longer arises.

Above, representative embodiments were shown, but the present invention is not limited to the above embodiments. The above embodiments can be changed to various shapes, structures, materials, etc. within a range not departing from the concept of the present invention.

What is claimed is:

1. A blower comprising:

a gas blowing part which is configured to hold an impeller blowing a gas, a motor part which is configured to hold a rotor extending in an axial direction which makes the impeller rotate, and a partition wall part which partitions the gas blowing part from the motor part, wherein one end part of the rotor passes through the partition wall part in the axial direction to support a center of rotation part of the impeller present inside the gas blowing part, a noncontact type shaft seal is arranged at a through hole of the partition wall part through which the one end part of the rotor passes, and a surface of the partition wall part facing in the axial direction that extends a length from the noncontact type shaft seal to an outer perimeter of the impeller forming a clearance between the surface of the partition wall part and a bottom surface of the impeller, and wherein the surface of the partition wall part facing in the axial direction is formed with a plurality of concentric grooves separate from the shaft seal, the plurality of concentric grooves surround the shaft seal, and each of the plurality of concentric grooves are formed with:

1) a bottom surface that extends below the surface of the partition wall part in the axial direction to face a back surface of the impeller, 2) a first side surface positioned at a first distance from the shaft seal and extending from the surface of the partition wall part to the bottom surface in the axial direction, and 3) a second side surface positioned at a second distance from the shaft seal and extending from the surface of the partition wall part to the bottom surface in the axial direction, wherein the second distance is smaller than the first distance, and wherein the first side surface and the second side surface surround the bottom surface to trap foreign matter to prevent the foreign matter from contacting the shaft seal and the rotor.

2. The blower according to claim 1 wherein the plurality of concentric grooves includes at least one ring-shaped groove.

3. The blower according to claim 2 wherein a distance between an axis of rotation of the impeller and the first side surface of the at least one ring-shaped groove at an outer circumference side is "r1", a distance between an axis of rotation of the impeller and the second side surface of the at least one ring-shaped groove at an inner circumference side is "r2", a distance between the impeller and the partition wall part is "h1", a distance between the surface of the impeller facing the partition wall part and the bottom surface of the at least one ring-shaped groove is "h2", and a space which is configured by the at least one ring-shaped groove and the back surface of the impeller for trapping foreign matter is formed so as to satisfy the relationships of $r2<r1$, $h1<h2$, and $r1 \cdot h1<r2 \cdot h2$.

4. The blower according to claim 1 wherein an adhesive is arranged inside the plurality of concentric grooves.

5. The blower according to claim 1 further comprising a sensor which detects a predetermined amount of foreign matter being built up in at least one of the plurality of concentric grooves.

6. The blower according to claim 1 wherein the partition wall part is formed with a discharge path which discharges foreign matter which has built up in at least one of the plurality of concentric grooves.

7. The blower according to claim 1 wherein the surface of the partition wall part in which the plurality of concentric grooves are formed is perpendicular to the axial direction.

8. The blower according to claim 1 wherein the motor part is formed with an exhaust port which evacuates an internal volume of the motor part.

* * * * *